US006732733B1

(12) United States Patent
Brostrom et al.

(10) Patent No.: US 6,732,733 B1
(45) Date of Patent: May 11, 2004

(54) HALF-MASK RESPIRATOR WITH HEAD HARNESS ASSEMBLY

(75) Inventors: Gerald M. Brostrom, Burnsville, MN (US); David M. Castiglione, Hudson, MN (US); William A. Mittelstadt, Woodbury, MN (US); Alan J. Solyntjes, Richfield, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/535,847

(22) Filed: Mar. 27, 2000

Related U.S. Application Data

(63) Continuation-in-part of application No. 08/943,757, filed on Oct. 3, 1997, now Pat. No. 6,062,221.

(51) Int. Cl.[7] ..... A62B 18/08

(52) U.S. Cl. ..... 128/206.27; 128/206.28; 128/207.11

(58) Field of Search ..... 128/206.27, 207.11, 128/207.13, 207.18, 207.17, 201.22, 205.25, 206.28

(56) References Cited

U.S. PATENT DOCUMENTS

| | | | |
|---|---|---|---|
| 1,356,708 A | 10/1920 | Goodyear | |
| 1,395,760 A | 11/1921 | Monro | |

(List continued on next page.)

FOREIGN PATENT DOCUMENTS

| | | | | |
|---|---|---|---|---|
| BR | 203741 | * | 9/2000 | ..... 128/207.11 |
| DE | 414007 | | 10/1921 | |
| DE | 528975 | | 5/1927 | |
| DE | 535040 | * | 10/1931 | |
| DE | 141110 | | 2/1979 | |
| DE | 141110 | * | 4/1980 | |
| DE | 9300181 U | * | 3/1993 | |
| DE | 9300181 U1 | | 3/1993 | |
| DE | 43 23 926 A1 | | 1/1995 | |
| DE | 195 16 859 A1 | | 11/1995 | |
| DE | 1950160859 A1 | * | 11/1995 | |
| DE | 19714325 A1 | | 10/1998 | |
| DE | 414007 | * | 5/2000 | ..... 128/207.11 |
| DE | 528975 | * | 7/2000 | ..... 128/207.11 |
| EP | 0085746 | * | 8/1983 | |
| EP | 0 085 746 A2 | | 8/1983 | |
| EP | 0 085 746 A3 | | 8/1983 | |
| EP | 0 085 746 B2 | | 6/1985 | |
| EP | 0 085 746 B1 | | 6/1985 | |
| EP | 0 808 641 A1 | | 11/1997 | |
| EP | 0808641 A1 | * | 11/1997 | |
| FR | 780746 | | 5/1935 | |
| FR | 48776 | * | 3/1938 | ..... 128/207.11 |
| GB | 203741 | | 9/1923 | |
| GB | 298810 | | 1/1929 | |

(List continued on next page.)

OTHER PUBLICATIONS

"Gas Mask," Model GM–12D–1, GM, 1994.*
"Gas Masks," Model GM–12D–1, GM, 1994.

*Primary Examiner*—Aaron J. Lewis
(74) *Attorney, Agent, or Firm*—Karl G. Hanson; Kevin W. Raasch

(57) ABSTRACT

A half-mask respirator is retained on a wearer's head by upper and lower straps and a strap support. The upper and lower straps connect to the strap support at upper and lower strap attachment points on each side of the strap support. The distances between the attachment points on each opposing side of the strap support are fixed when the strap support is located on the wearer's skull and the half-mask respirator is mounted over the wearer's nose and mouth. As a result, the lower strap is supported above the neck of the wearer which eliminates a potential source of discomfort for the wearer.

36 Claims, 6 Drawing Sheets

U.S. PATENT DOCUMENTS

| | | | | | |
|---|---|---|---|---|---|
| 1,395,761 | A | * | 11/1921 | Monro et al. | 128/207.11 |
| 1,706,601 | A | | 3/1929 | Drager | |
| 1,812,380 | A | | 6/1931 | Stelzner | |
| 1,942,442 | A | * | 1/1934 | Motsinger | 128/207.11 |
| 2,036,850 | A | | 4/1936 | Bullard | |
| 2,176,709 | A | * | 10/1939 | Dym | 128/207.11 |
| 2,353,643 | A | | 7/1944 | Bulbulian | |
| 2,391,677 | A | | 12/1945 | Bulbulian | |
| 2,400,077 | A | * | 5/1946 | Dauster | 128/207.11 |
| 2,406,888 | A | * | 9/1946 | Meidenbauer, Jr. | 128/205.25 |
| 2,444,417 | A | | 7/1948 | Bierman | |
| 2,540,567 | A | | 2/1951 | Bennett | |
| 2,671,445 | A | * | 3/1954 | Charbonnel | 128/207.11 |
| 2,810,385 | A | | 10/1957 | Reed | |
| 2,827,900 | A | * | 3/1958 | Marietta | |
| 2,875,757 | A | | 3/1959 | Galleher, Jr. | |
| 2,928,387 | A | * | 3/1960 | Layne | |
| 2,974,665 | A | * | 3/1961 | Motsinger | 128/207.11 |
| 3,013,556 | A | | 12/1961 | Galleher, Jr. | |
| 3,056,402 | A | * | 10/1962 | Dickinson | |
| 3,079,917 | A | * | 3/1963 | Pate | |
| 3,092,105 | A | * | 6/1963 | Gabb | |
| 3,117,574 | A | * | 1/1964 | Reploglo | |
| 3,220,443 | A | | 11/1965 | Smith et al. | |
| 3,234,940 | A | * | 2/1966 | Morton, Jr. | |
| 3,330,274 | A | | 7/1967 | Bennett | |
| 3,347,229 | A | * | 10/1967 | Heitman | |
| 3,747,599 | A | | 7/1973 | Malmin | |
| 3,752,157 | A | | 8/1973 | Malmin | |
| 3,792,702 | A | * | 2/1974 | Delest | |
| RE28,102 | E | | 8/1974 | Mayhew | |
| 4,157,090 | A | | 6/1979 | Phillips | |
| 4,215,682 | A | | 8/1980 | Kubik et al. | |
| 4,331,143 | A | | 5/1982 | Foster | |
| 4,414,973 | A | | 11/1983 | Matheson et al. | |
| 4,419,993 | A | | 12/1983 | Petersen | |
| 4,536,440 | A | | 8/1985 | Berg | |
| 4,537,192 | A | | 8/1985 | Foster | |
| 4,592,815 | A | | 6/1986 | Nakao | |
| D285,374 | S | | 8/1986 | Huber et al. | |
| 4,603,692 | A | * | 8/1986 | Montesi | |
| 4,807,619 | A | | 2/1989 | Dyrud et al. | |
| 4,850,346 | A | * | 7/1989 | Michel et al. | |
| 4,874,399 | A | | 10/1989 | Reed et al. | |
| 4,934,361 | A | * | 6/1990 | Michel et al. | |
| 4,960,121 | A | | 10/1990 | Nelson et al. | |
| 5,020,193 | A | | 6/1991 | Kunze | |
| 5,025,052 | A | | 6/1991 | Crater et al. | |
| 5,038,776 | A | | 8/1991 | Harrison et al. | |
| 5,062,421 | A | * | 11/1991 | Burns et al. | |
| 5,065,756 | A | | 11/1991 | Rapoport | |
| 5,086,768 | A | | 2/1992 | Niemeyer | |
| 5,099,026 | A | | 3/1992 | Crater et al. | |
| 5,181,507 | A | * | 1/1993 | Michel et al. | |
| 5,191,882 | A | | 3/1993 | Vogliano | |
| 5,237,986 | A | * | 8/1993 | Seppala et al. | |
| 5,265,595 | A | | 11/1993 | Rudolph | |
| 5,269,024 | A | | 12/1993 | Wyatt | |
| 5,291,880 | A | * | 3/1994 | Almovist et al. | 128/201.22 |
| 5,307,796 | A | | 5/1994 | Kronzer et al. | |
| 5,374,458 | A | | 12/1994 | Burgio | |
| 5,394,568 | A | * | 3/1995 | Brostrom et al. | 128/207.11 |
| 5,411,576 | A | | 5/1995 | Jones et al. | |
| 5,429,126 | A | * | 7/1995 | Bracken | 128/201.22 |
| 5,429,683 | A | | 7/1995 | Le Mitouard | |
| 5,464,010 | A | * | 11/1995 | Byram | 128/207.11 |
| 5,472,481 | A | | 12/1995 | Jones et al. | |
| 5,488,948 | A | * | 2/1996 | Dubruille et al. | 128/207.11 |
| 5,496,507 | A | | 3/1996 | Angadjivand et al. | |
| 5,503,147 | A | | 4/1996 | Bertheau | |
| 5,509,436 | A | | 4/1996 | Japuntich et al. | |
| 5,542,128 | A | | 8/1996 | Lomas | |
| 5,555,569 | A | * | 9/1996 | Lane | 128/201.22 |
| 5,570,689 | A | | 11/1996 | Starr et al. | |
| 5,617,849 | A | | 4/1997 | Springett et al. | |
| 5,656,368 | A | | 8/1997 | Braun et al. | |
| D383,204 | S | | 9/1997 | Lomas | |
| 5,662,101 | A | | 9/1997 | Ogden et al. | |
| 5,690,102 | A | | 11/1997 | Bertheau et al. | |
| 5,706,804 | A | | 1/1998 | Baumann et al. | |
| 5,724,677 | A | | 3/1998 | Bryant et al. | |
| 5,908,598 | A | | 6/1999 | Rousseau et al. | |
| 5,921,239 | A | | 7/1999 | McCall et al. | |
| 5,924,420 | A | | 7/1999 | Reischel et al. | |
| 5,941,245 | A | | 8/1999 | Hannah et al. | |
| 5,992,414 | A | | 11/1999 | Tayebi et al. | |
| 6,062,221 | A | * | 5/2000 | Brostrom et al. | 128/207.11 |
| 6,457,473 | B1 | | 10/2002 | Brostrom et al. | |

FOREIGN PATENT DOCUMENTS

| | | | | |
|---|---|---|---|---|
| GB | 298810 | * | 1/2000 | 128/207.11 |
| JP | 34-12900 | * | 8/1959 | |
| NL | 50041 | * | 3/1941 | 128/207.11 |
| RU | 199669 | | 12/1965 | |
| SU | 199669 | * | 10/1965 | 128/207.11 |
| WO | WO 86/01734 | * | 3/1986 | |
| WO | WO 87/01949 | | 4/1987 | |
| WO | WO 98/24499 | | 6/1998 | |
| WO | WO 98/58558 | | 12/1998 | |
| WO | WO 99/06116 | | 2/1999 | |
| WO | WO 99/16532 | | 4/1999 | |
| WO | WO 99/16533 | | 4/1999 | |
| WO | WO 99/16945 | | 4/1999 | |
| WO | WO 99/20349 | | 4/1999 | |
| WO | WO 99/58197 | | 11/1999 | |
| WO | WO 00/50122 | | 8/2000 | |

* cited by examiner

HALF-MASK RESPIRATOR WITH HEAD HARNESS ASSEMBLY

RELATED APPLICATIONS

This application is a continuation-in-part of U.S. patent aplication Ser. No. 08/943,757, filed on Oct. 3, 1997 now U.S. Pat. No. 6,062,231, which is hereby incorporated by reference in its entirety.

BACKGROUND

The present invention generally relates to respirators, and more particularly, to a half-mask respirator including a head harness assembly having pairs of upper and lower straps connected to a strap support.

Half-mask respirators (sometimes referred to as "face masks") are worn over the mouth and nose, but not eyes, of a person for two common purposes: (1) to prevent impurities or contaminants from entering the wearer's breathing tract; and/or (2) to protect others from being exposed to pathogens and other contaminants exhaled by the wearer. In the first situation, the respirator is worn in an environment where the air contains particles harmful to the wearer, for example, in an auto body shop. In the second situation, the respirator is worn in an environment where there is a high risk of infection, for example, in an operating room.

To accomplish either of these purposes, a snug fit to the wearer's face must be maintained. The desired fit is achieved in many half-mask respirators by using a pair of straps, with a first strap extending laterally from the respirator body around the back of the wearer's head above the ears and a second strap extending laterally from the respirator body around the back of the wearer's neck.

One problem with this design is that the strap that extends around the wearer's neck can irritate the wearer. The irritation is caused by the strap rubbing against the wearer's skin as the wearer's head rotates from side-to-side. That irritation is undesirable because of the negative affect it can have on the wearer's motivation to use the respirator as directed. For example, if the lower strap is loosened to reduce the irritation, improper tension from strap may exert forces that skew the mask from its intended wearing configuration. This can cause leaks around the respirator perimeter, creating potential safety concerns.

SUMMARY OF THE INVENTION

The present invention provides a half-mask respirator that is retained on a wearer's head by a head harness assembly including upper and lower straps and a strap support. The upper and lower straps connect to the strap support at upper and lower strap attachment points on each side of the strap support. The distances between the attachment points on each side of the strap support are fixed when the strap support is located on the wearer's skull and the half-mask respirator is mounted over the wearer's nose and mouth. Because the distances between the upper and lower straps are fixed by the strap support, the lower strap can be supported above the wearer's neck to eliminate a potential source of discomfort for the wearer.

The respirator body of the half-mask respirators of the invention can take many different forms. For example, the respirator body can be provided in a drop down configuration that may or may not include a carriage. The respirator body may be provided in the form of a porous filtering face mask or it may be a respirator including a non-porous body and filter cartridges.

In all embodiments, however, the half-mask respirators of the invention include the strap support and upper and lower straps in a configuration that removes the lower strap from the back of the wearer's neck when the half-mask respirator is in position over the wearer's nose and mouth.

In those embodiments in which at least one pair of support straps is removably attached to the strap support, one advantage of the present invention is that the respirator body is capable of being retained at multiple positions without completely removing the half-mask respirator. The respirator body is able to be retained at a first position covering the nose and mouth of the wearer and at a second position dropped down from the face of the wearer without moving the strap support from the head of the wearer. The half-mask respirator may hang near the user's body in the dropped down position. This is advantageous in situations where the user needs access to his or her mouth and does not have to take the time to set the half-mask respirator down and re-don the half-mask respirator when needed. Also, the half-mask respirator is out of the user's way when hanging near the body, thereby allowing substantially unobstructed working conditions. This flexibility saves time and protects the half-mask respirator and accompanying filters from contamination. In addition, the half-mask respirator is easily adjusted and conforms to multiple facial configurations.

Another advantage is that the half-mask respirator may be retained against the face of the wearer at four points by the upper and lower straps of the head harness assembly. Such a four point seal can provide greater protection against contaminants.

In brief summary, in one aspect, the present invention provides a half-mask respirator that includes a body configured to cover the nose and mouth of the wearer. The respirator also includes a strap support located on the wearer's skull when the respirator body is in position over the nose and mouth of the wearer. The respirator body is held in place by at least two upper straps that extend from opposite sides of an upper portion of the respirator body to opposing sides of the strap support, the upper straps connected to the strap support at upper strap attachment points. Also holding the respirator body in place are at least two lower straps that extend from opposite sides of a lower portion of the respirator body to opposing sides of the strap support, the lower straps connected to the strap support at lower strap attachment points. The distances between the upper and lower strap attachment points on each opposing side of the strap support are fixed when the strap support is located on the wearer's skull and the respirator body is in position over the nose and mouth of the wearer. As a result, the lower straps do not extend around the back of the wearer's neck.

In brief summary, in another aspect, the present invention provides a halfmask respirator that includes a body configured to cover the nose and mouth of the wearer. The respirator also includes a support crown located on the wearer's skull when the respirator body is in position over the nose and mouth of the wearer. The respirator body is held in place by at least two upper straps that extend from opposite sides of an upper portion of the respirator body to opposing sides of the support crown, the upper straps connected to the support crown at upper strap attachment points. Also holding the respirator body in place are at least two lower straps that extend from opposite sides of a lower portion of the respirator body to opposing sides of the support crown, the lower straps connected to the support crown at lower strap attachment points. The distances between the upper and lower strap attachment points on each opposing side of the support crown are fixed when the support crown is located on the wearer's skull and the respirator body is in position over the nose and mouth of the wearer. As a result, the lower straps do not extend around the back of the wearer's neck. Additionally, the lower straps are connected to the respirator body below support crown when the support crown is located on the wearer's skull and the respirator body is in position over the nose and mouth of the wearer.

These features of novelty and various other advantages which characterize the invention are pointed out with particularity in the claims annexed hereto and forming a part hereof. However, for a better understanding of the invention and its advantages, reference should be made to the drawings which form a further part hereof, and to the accompanying descriptive matter, in which illustrative embodiments of the invention are described.

DETAILED DESCRIPTION OF ILLUSTRATIVE EMBODIMENTS OF THE INVENTION

Figure 1:
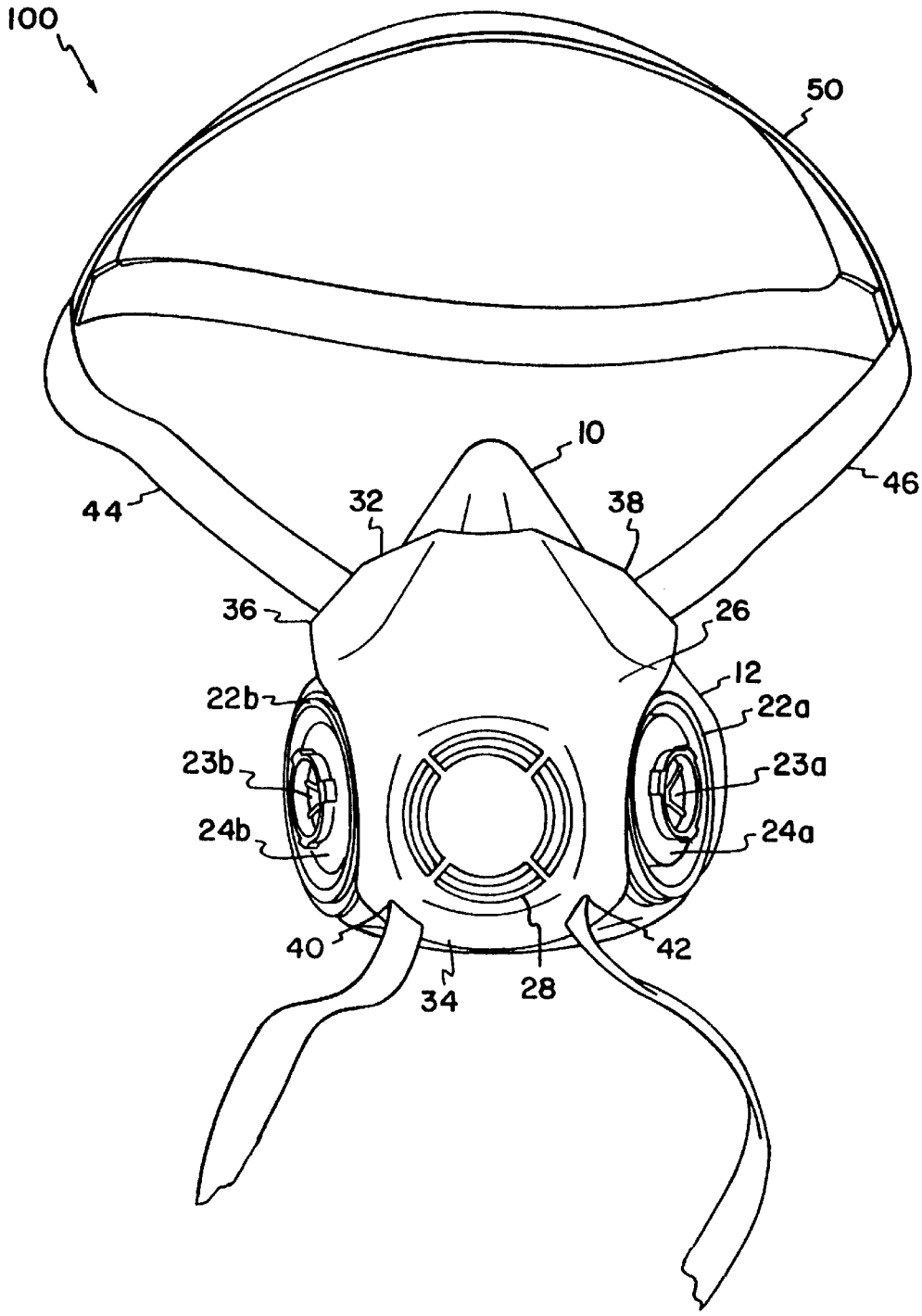
FIG. 1 shows a front perspective view of one half-mask respirator 100 according to the principles of the present invention.

Illustrative embodiments of the invention will be described in detail with reference to the drawings, wherein like reference numerals represent like parts and assemblies throughout the several views. Reference to these illustrative embodiments does not limit the scope of the invention, which is limited only by the scope of the claims attached hereto.

In general, the present invention relates to a half-mask respirator with a head harness assembly that includes upper and lower straps for retaining the half-mask respirator on a wearer's head. More particularly, the present invention relates to a half-mask respirator that is retained on a wearer by upper and lower straps and a strap support. The upper and lower straps connect to the strap support at upper and lower strap attachment points on each side of the strap support.

Although the half-mask respirators of the present invention are described as having pairs of upper and lower support straps that extend from a respirator body to a strap support, it should be understood that a single continuous integral strap body may be used to provide two or more of the upper and/or lower straps. As used in connection with the invention, "strap" means a section of one continuous elongate strap body that is attached at the respirator body at one end and which extends to the strap support where it is attached at its opposite end to provide a force that holds the respirator body in position against a wearer's face. Each strap body may continue past any one of the attachment points on either respirator body or the strap support, as long as that section of the strap body located between the corresponding attachment points on the respirator body and the strap support supplies the desired retention force.

Figure 2:
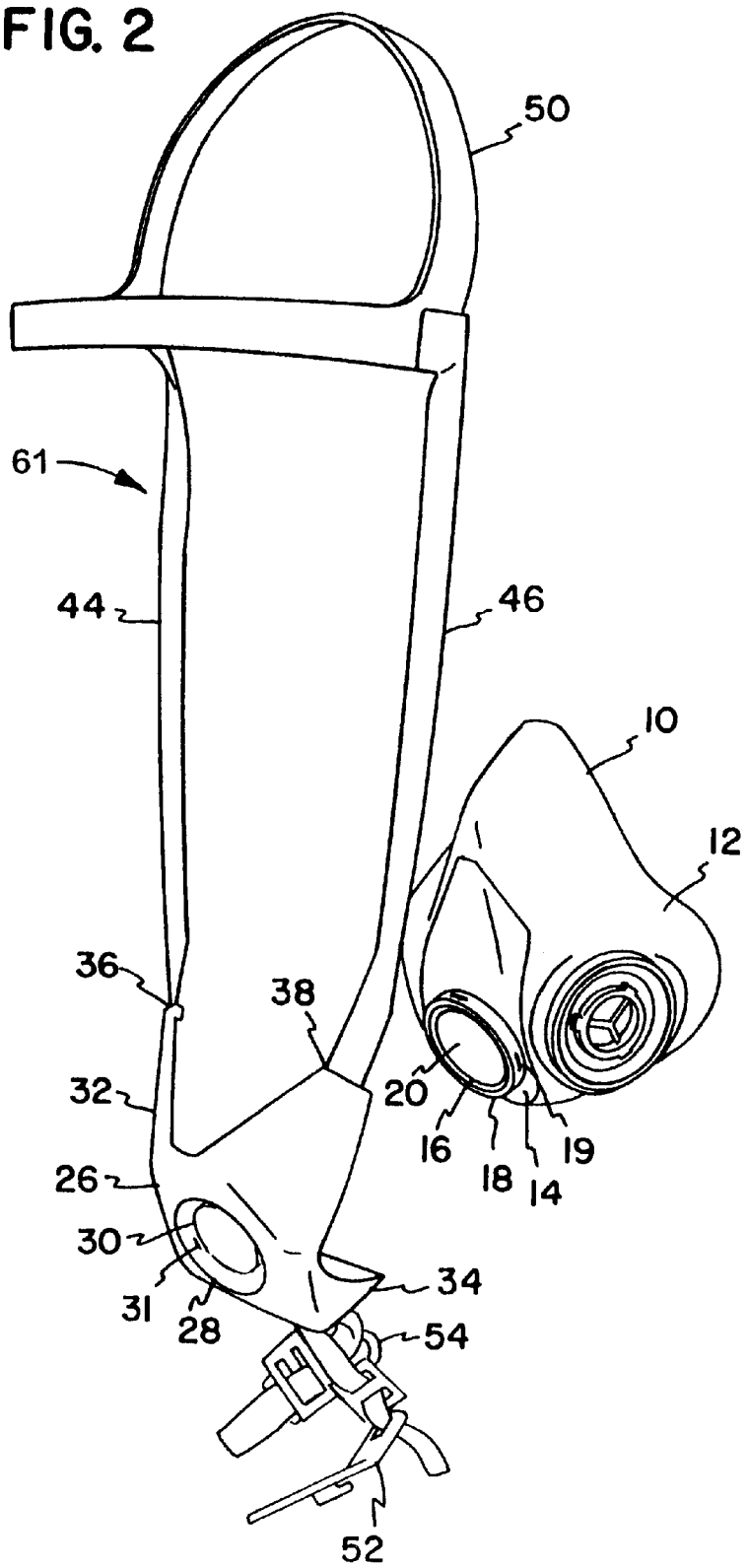
FIG. 2 shows a perspective view of a carriage 26 detached from the half-mask respirator 100.

Referring now to FIGS. 1 and 2, a half-mask respirator generally shown as 100, is configured to fit over the mouth and nose of a wearer. The half-mask respirator 100 has a respirator body 10. Many such respirator bodies are known, such as the Series 6000™ by Minnesota Mining and Manufacturing Company, the 5500 by North Safety Products, and the Advantage 200 by MSA. The illustrated respirator body has a seal portion 12 and a central portion 14. The seal portion 12 is configured to provide a seal against the wearer's face. The seal portion 12 may be constructed of rubber-like material and may also be generally contoured to serve as a sealing surface. The central portion 14 may be constructed of rigid material and to serve as a support for the seal portion 12.

An exhalation port 16 is typically located on the central portion 14. A lip member 18 may be located on the outer circumferential wall of the exhalation port 16. The lip member 18 is recessed away from the respirator body 10. The lip member 18 may have four grooves 19 located on the outer wall. A valve 20 is positioned across the outside of exhalation port 16 such that the valve 20 covers the entire port 16, thereby forming a substantially airtight seal. The valve 20 acts as a one-way valve, allowing air to exit out of the respirator body, but preventing air from entering the respirator body when the wearer breathes in. Such valves are well understood in the art.

Inhalation ports 22*a* and 22*b* are typically disposed on opposite sides of the exhalation port 16. Inhalation valves 23*a* and 23*b* are located across ports 22*a* and 22*b*, respectively, thereby forming a substantially airtight seal. The inhalation valves 23*a* and 23*b* act as a one-way valve allowing air to enter the respirator body when the wearer breathes in, but preventing air from escaping the respirator body when the wearer exhales. Inhalation seals 24*a* and 24*b* are located within inhalation ports 22*a* and 22*b* and proximal to inhalation valves 23*a* and 23*b*, respectively. Inhalation seals 24*a* and 24*b* seal off the inhalation ports 22*a* and 22*b* such that substantially all inhaled air passes through inhalation valves 23*a* and 23*b*, respectively. Filters (not shown) may be placed over the inhalation ports 22*a* and 22*b* to remove particulates, vapors, aerosols, or other toxins from incoming air as is well known in the art. The particular filter may take a variety of different forms depending upon the impurities to be filtered. For example, a filter cartridge, as is well known in the art, is attached to each inhalation port, thereby providing filtering capabilities.

A carriage 26 is associated with the respirator body 10. The carriage may be permanently or detachably connected to the respirator body. In a preferred embodiment, the carriage 26 is configured to substantially match the contours of the respirator body 10, such that the carriage fits over the respirator body 10. The carriage 26 is removably connected to the respirator body 10 by conventional connecting means. The carriage 26 is constructed of substantially rigid material such as plastic. A port 28 is located on the carriage 26 such that the air exiting the exhalation port 16 is channeled through the port 28.

In one configuration, the port 28 is located to align with the exhalation port 16 of the respirator body 10. A lip member 30 is located on the outer circumferential wall of the port 28. The lip member 30 has four protrusions 31 located on the inner circumferential wall of the lip member 30. The protrusions 31 are configured to connect with the grooves 19 of the lip member 18, thereby connecting the respirator body 10 and the carriage 26. The size of the lip 18, grooves 19, lip 30, and protrusions 31 are designed such that the respirator body 10 snaps into the carriage 26 to form an attachment. The attachment is such that a force encountered under ordinary working conditions will not disengage the carriage 26 from the respirator body 10. The respirator body 10 and the carriage 26 are detached by manually forcing the carriage 26 away from the respirator body 10. Other conventional attachment means can be used and the present invention is not limited to the lip-to-lip attachment system disclosed. For example, that attachment may involve a number of protrusions snapping into a complimentary number of recesses. Furthermore, the attachment system is not limited to being located on the exhalation or inhalation ports. The attachment systems allows for the attachment of different respirator bodies with different seal and filter characteristics to the carriage 26.

The carriage 26 may be permanently or detachably connected to the respirator body 10. In the illustrated embodiment, the carriage 26 is detachably connected to respirator body 10. The carriage 26 has an upper portion 32 and a lower portion 34. The upper portion 32 matches the shape of the respirator body 10 and angles back near the seal portion 12. The lower portion 34 matches the general shape of the respirator body 10 and angles back near the seal portion 12. The upper portion 32 has a first upper guide 36 and a second upper guide 38. The lower portion 34 has a first lower guide 40 and a second lower guide 42. The guides are designed to accommodate a strap and may take the form of slots, eyelets, or any structure having a suitable opening that permits the strap to move within the opening.

The lower guides 40, 42 are angled to permit the respirator body to be pulled in an up and down direction relative to the wearer's face and the strap(s) to be pulled about the wearer's head without substantially binding and consequently damaging the straps.

The first strap 44 and the second strap 46 have proximal and distal ends. The proximal ends of the first strap 44 and the second strap 46 are connected to a strap support in the form of a support crown 50. The support crown 50 is generally oval shaped and configured to fit and conform to the head of the wearer. The support crown 50 may preferably be constructed of substantially flexible material to conform to the wearer's head. The support crown 50 may be designed such that protective head gear can be fitted over the support crown 50 without causing undue discomfort because it is often necessary to wear protective head gear, such as a hard hat, in conjunction with a half-mask respirator. Alternative strap supports can be used, with some alternative embodiments depicted in, e.g., FIGS. 4–6.

The first strap 44 and second strap 46 may be formed of elastic fabric material as is well known in the art. In an alternative embodiment, the straps may be formed of rigid materials that are flexibly connected to the support crown 50 so to provide resiliency.

The distal ends of the straps 44 and 46 connect to the support crown 50 behind the head of the wearer as will be described in connection with various embodiments below. This has the advantage of increased comfort, as straps more freely turn with head and support crown movement. This is advantageous when the movement of the support crown 50 is severely restricted, such as when the user is wearing protective head gear. If the distal ends of the straps 44 and 46 are connected to each other behind the wearer's neck as in conventional designs, the portions of the straps 44 and 46 located on the wearer's neck move relative to the skin. That relative movement can cause irritation and discomfort on the back of the head of the wearer.

Figure 3:
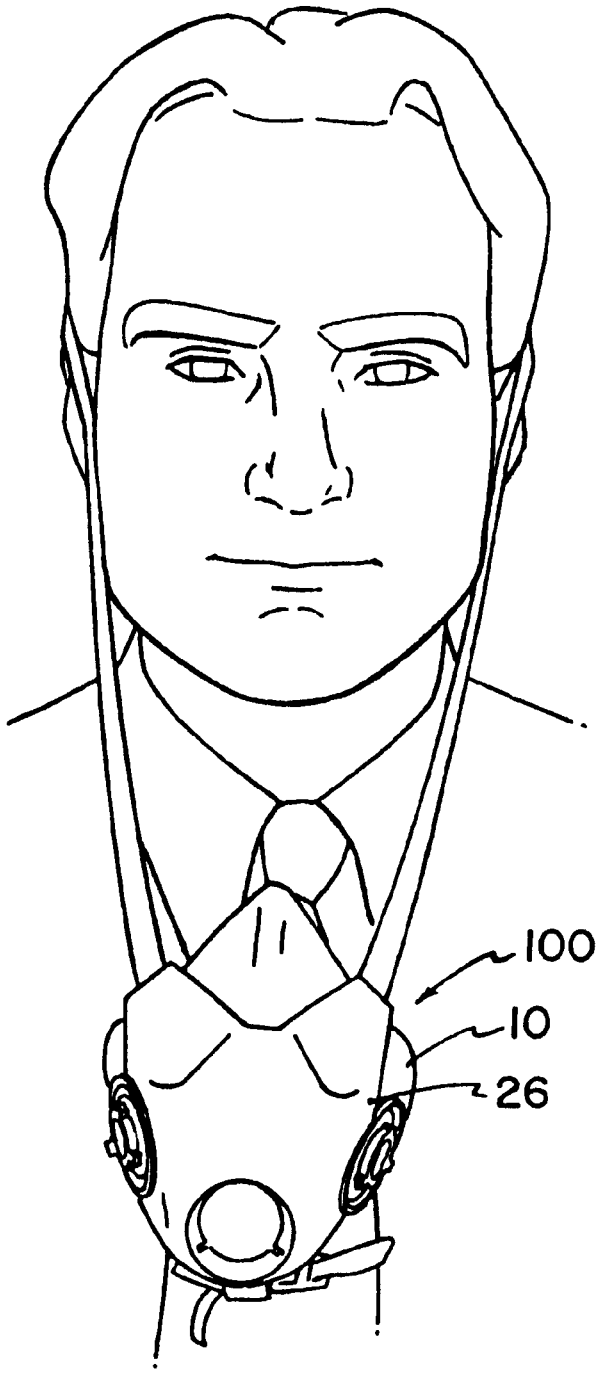
FIG. 3 shows a perspective view of the half-mask respirator 100 of FIG. 1 in the dropped down position on a wearer.

Referring now to FIG. 3, the respirator body of the half-mask respirator 100 is dropped down to a position below the face of the wearer. The respirator body is dropped down by disconnecting straps 44 and 46 from the support crown (not shown). The respirator body can then be slid down straps 44 and 46 to a suitable position. The respirator body hangs near the wearer's body. The support crown remains on the wearer's head. With the body in the dropped down position, the wearer can perform tasks while having access to his or her mouth. Also, since the half-mask respirator hangs near the wearer's body, the wearer's view is relatively unobstructed.

When the filtered breathing is needed, the wearer simply slides the respirator body up to his or her nose and mouth and connects straps 44 and 46 to the support crown. This provides for quick donning which is highly advantageous. Often, environments become quickly contaminated, and the wearer must be able to quickly don the half-mask respirator. This is not possible where the wearer must retrieve the half-mask respirator, or where the wearer must spend time readjusting the straps.

Figure 4:
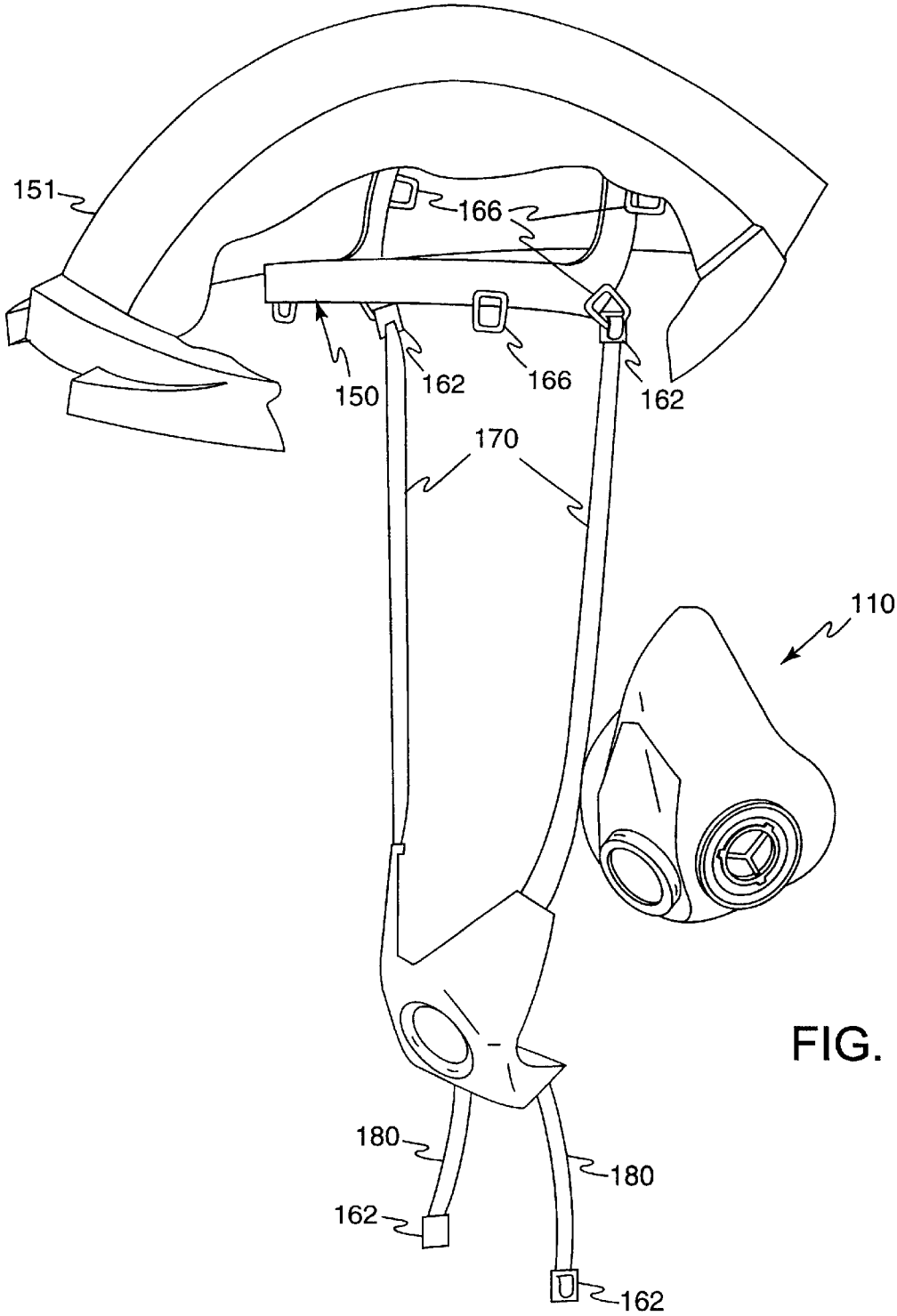
FIG. 4 shows a perspective view of another half-mask respirator 110 attached to a strap support 150 that is, in turn, attached to a hard hat 151 according to the present invention.

FIG. 4 illustrates another half-mask respirator of the invention connected including a support crown 150 preferably attached to a hard hat 151 (that is partially cut-away in FIG. 4 to expose the support crown 150). The respirator body 110 is attached to a pair of upper straps 170 that extend from the respirator body 110 to the support crown 150. At the points at which each of the upper straps 170 attach to the support crown 150, both upper straps 170 are attached by a mechanism that, in the illustrated embodiment, includes a hook 162 at the end of each upper strap 170 and complementary loops 166 on the support crown 150.

A pair of lower straps 180 are attached to the respirator body 110 at points that are lower on the respirator body 110 than the points at which the upper straps 170 are attached to the respirator body 110. The lower straps 180 extend from the respirator body 110 to the support crown 150. At the points at which each of the lower straps 180 attach to the support crown 150, both lower straps 180 are attached by hooks and loops as illustrated in connection with the upper straps 170.

Although both the upper straps 170 and the lower straps 180 are depicted as being removably attached to the support crown 150, one or more of the straps 170 and 180 could alternatively be permanently attached to the support crown 150 (see, e.g., the attachment of the proximal ends of straps 44 and 46 in the embodiment depicted in FIGS. 1 and 2).

Removably attaching at least one of the straps 170 and 180 to the support crown 150 may allow a wearer to remove the respirator body 110 from the face without completely removing the support crown 150 from the head. For example, if the lower straps 180 were permanently attached to the support crown 150, detachment of the upper straps 170 from the support crown 150 could allow the respirator body 110 to be dropped from the wearer's face and suspended from the support crown 150 by the lower straps 180. In yet another alternative, the upper strap 170 and lower strap 180 on one side of the half-mask respirator could be detachable, thus allowing the respirator body 110 to be suspended from one side of the support crown 150.

Another optional feature illustrated in FIG. 4 is that the support crown 150 may include a plurality of loops 166 that allow the wearer to adjust the positions at which the upper and lower straps 170 and 180 attach to the strap support 150. That adjustment may further improve the comfort of the half-mask respirator for the wearer. Alternatively, the location of one pair of loops 166 on each side of the strap support 150 may be adjustable by, e.g., mounting a single pair of loops 166 on mechanisms that slide along the strap support 150. A variety of other adjustment mechanisms that allow for adjustments in the distance between the attachment points of the upper and lower straps 170 and 180 to the strap support 150 could be substituted for those specifically described in illustrative embodiments of the invention. Examples of some alternative mechanisms for attaching the straps to either the respirator body of the strap support can be found in, e.g., International Publication WO 99/06116 (FILTERING FACE MASKS HAVING ONE OR TWO STRAPS).

In an alternative embodiment, protective head gear, such as a hard hat with its own attached support crown, may also function as a strap support in accord with the principles of the invention. A separate strap support would not be required because the straps could connect directly to the hard hat rather than the support crown. In such an embodiment, the hard hat and straps have suitable mechanisms, typically similar to those described in connection with the support straps to connect to the straps to the hard hat. This may be advantageous in an environment that requires the constant use of a hard hat.

Figure 5:
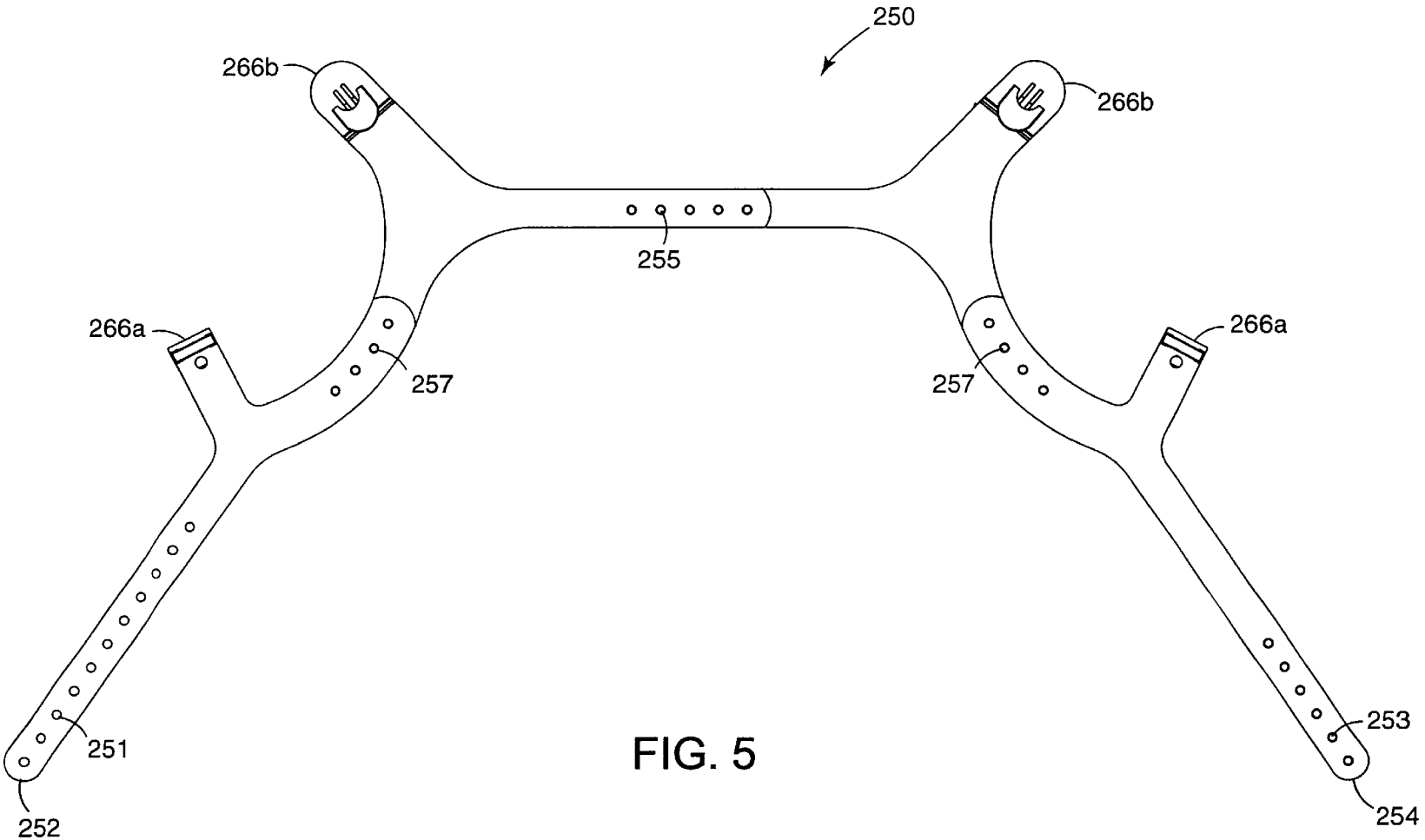
FIG. 5 illustrates another embodiment of a strap support 250 for use with the half-mask respirators of the present invention.

FIG. 5 depicts an alternative strap support 250 in a flattened configuration for illustration purposes. The strap support 250 includes upper strap attachment points 266*a* and lower strap attachment points 266*b*. A series of apertures 251 may be formed in proximate end 252 along with a series of complementary posts 253 proximate opposing end 254 in the strap support 250. The apertures 251 and complementary posts 253 provide one example of a mechanism for adjusting the distance between the upper strap attachment points 266*a* on opposing sides of the strap support 250. In addition, the apertures 251 and posts 253 provide a mechanism for adjusting the circumference of the strap support 250 to fit heads of various sizes in a manner similar to that used in, e.g., hardhats, baseball caps and other headwear.

Also included in the strap support 250 are similar complementary posts/apertures 255 (depicted assembled) located between lower strap attachment points 266*b*. This adjustment mechanism provides the ability to vary the distance between the lower strap attachment points 266*b* on opposing sides of the strap support 250. In addition, the posts/apertures 255 provide a mechanism for adjusting the circumference of the strap support 250.

Other optional adjustment mechanisms illustrated in FIG. 5 are the groups of posts/apertures 257 located between each pair of upper and lower strap attachment points 266*a* and 266*b* on each side of the strap support 250. These adjustment mechanisms provide the ability to vary the distances between the upper and lower strap attachment points 266*a* and 266*b* on opposing sides of the strap support 250. In addition, the posts/apertures 257 provide yet another mechanism for adjusting the circumference of the strap support 250.

Although the adjustment mechanisms illustrated in connection with strap support 250 in FIG. 5 are complementary sets of posts and apertures, any other suitable mechanisms could be used in place of the posts and apertures. For example, buckles, hook and loop closure materials, etc. could all be used in place of one or more of the sets of complementary posts and apertures.

Figure 6:
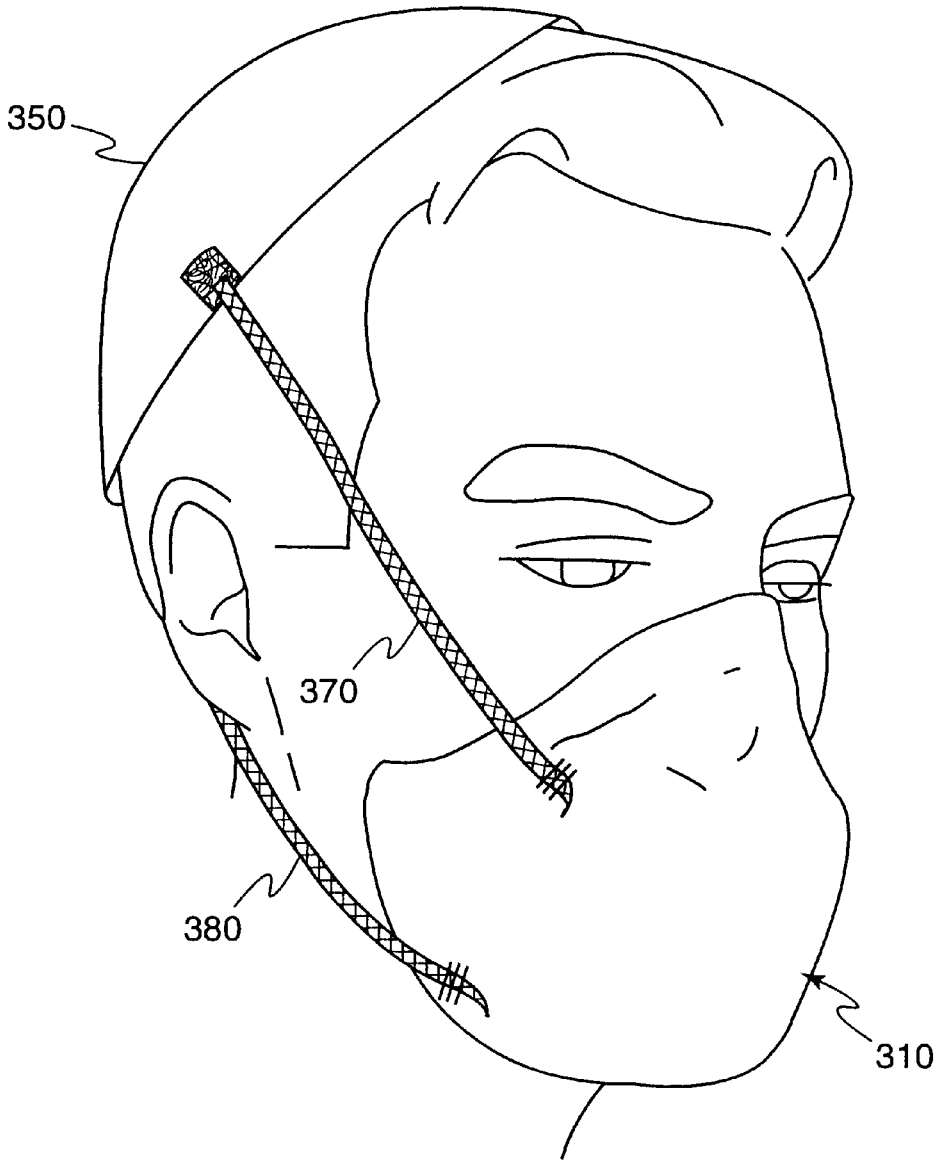
FIG. 6 illustrates an another half-mask respirator 310 attached to a strap support 350 according to the present invention.

FIG. 6 depicts another half-mask respirator of the present invention in which the respirator body 310 is in the form of a porous filtering face mask. Examples of some porous filtering mask bodies are described in, e.g., U.S. Pat. No. 5,307,706 to Kronzer et al., U.S. Pat. No. 4,807,619 to Dyrud, U.S. Pat. No. 4,536,440 to Berg, U.S Pat. No. 5,724,677 to Bryant et al., and D285,374 to Huber et al., as well as in International Publication No. WO 98/58558 by Angadjivand et al. Commercially available products include the 1800™, 1812™, 1838™, 1860™, and 8210™ brand masks sold by the 3M Company.

When a wearer inhales, air is drawn through the filtering material that is integral to the mask body 310. The filtering material may include a fibrous non-woven filtering material. Filtering materials that are commonplace on negative pressure half mask respirators like the respirator body 310 shown in FIG. 6 contain an entangled web of electrically charged melt-blown microfibers (BMF). BMF fibers typically have an average fiber diameter of about 20 micrometers ($\mu$m) or less, preferably about 2 to about 15 $\mu$m. When randomly entangled in a web, they have sufficient integrity to be handled as a mat. Examples of fibrous materials that may be used as filters in a mask body are disclosed in U.S. Pat. No. 5,706,804 to Baumann et al., U.S. Pat. No. 4,419,993 to Peterson, U.S. Reissue Pat. No. Re 28,102 to Mayhew, U.S. Pat. Nos. 5,472,481; 5,411,576 to Jones et al.; and U.S. Pat. No. 5,908,598 to Rousseau et al.

The fibrous materials may contain additives to enhance filtration performance, such as the additives described in U.S. Pat. Nos. 5,025,052 and 5,099,026 to Crater et al., and may also have low levels of extractable hydrocarbons to improve performance; see, for example, International Publication No. WO 99/16945 by Rousseau et al. Fibrous webs also may be fabricated to have increased oily mist resistance using the techniques described in U.S. Pat. No. 4,874,399 to Reed et al., and in International Publication Nos. WO 99/16532 and WO 99/16533, both by Rousseau et al. Electric charge can be imparted to nonwoven BMF fibrous webs using techniques described in, for example, U.S. Pat. No. 5,496,507 to Angadjivand et al., U.S. Pat. No. 4,215,682 to Kubik et al., and U.S. Pat. No. 4,592,815 to Nakao.

The respirator body 310 may include multiple layers such as a filter layer, an outer cover web, and an inner shaping layer. The cover web may protect the filter layer from abrasive forces and may also retain any fibers that may come loose from the filter layer. The cover web may also have filtering abilities, although typically not nearly as good as the filtering layer. The cover web may be made, e.g., from nonwoven fibrous materials containing polyolefins and polyesters (see, e.g., U.S. Pat. Nos. 4,807,619 and 4,536,440, as well as International Publication No. WO 98/58558 by Angadjivand et al.).

The shaping layer may provide structure to the mask body and support for filter layer. The shaping layer may be located on the interior or the exterior of the mask body, or it may be located on both sides of filter layer. The shaping layer can be made, for example, from a nonwoven web of thermally-bondable fibers molded into a cup-shaped configuration. The shaping layer can be molded in accordance with known procedures (see, e.g., U.S. Pat. No. 5,307,796 to Kronzer et al.). The shaping layer or layers typically are made of bicomponent fibers that have a core of a high melting material, such as polyethylene terephthalate, surrounded by a sheath of lower melting material so that when heated in a mold, the shaping layer conforms to the shape of the mold and retains this shape when cooled to room temperature. When pressed together with another layer, such as the filter layer, the low melting sheath material can also serve to bond the layers together.

Filtering face masks of the invention may also include a thermochromic fit indicating seal at its periphery to allow the wearer to easily ascertain if a proper fit has been established—see U.S. Pat. No. 5,617,849 to Springett et al. The face masks may also include additional layers, valves (see, e.g., U.S. Pat. No. 5,509,436), etc.

The respirator body 310 can be retained on a wearer's head by, on the depicted side, an upper strap 370 and a lower strap 380, both of which are connected to a strap support 350 in the form of a skull cap, which may be provided in the form of netting or any other suitable material.

In one embodiment, the strap support 350 and the ends of the upper and lower straps 370 and 380 may include, e.g., complementary hook and loop closure materials. As a result, the attachment points at which the upper and lower straps 370 and 380 attach to the strap support 350 may be adjusted. Once in place on the wearer, however, the distances between those attachment points on the strap support 350 are fixed to prevent the lower strap 380 from extending around the back of the wearer's neck.

The preceding specific embodiments are illustrative of the practice of the invention. This invention may suitably be practiced in the absence of any element or item not specifically described in this document. The complete disclosures of all patents, patent applications, and publications identified herein are incorporated into this document by reference in their entirety as if individually incorporated. Various modifications and alterations of this invention will become apparent to those skilled in the art without departing from the scope of this invention, and it should be understood that this invention is not to be unduly limited to the illustrative embodiments set forth herein.

What is claimed is:

1. A half-mask respirator that comprises:

a half-mask respirator body configured to cover the nose and mouth of the wearer;

a strap support located on the wearer's skull when the respirator body is in position over the nose and mouth of the wearer;

at least two upper straps that extend from opposite sides of an upper portion of the respirator body to opposing sides of the strap support, the upper straps connected to the strap support at upper strap attachment points; and at least two lower straps that extend from opposite sides of a lower portion of the respirator body to opposing sides of the strap support, the lower straps connected to the strap support at lower strap attachment points, wherein the at least two lower straps do not extend around the back of the wearer's neck;

wherein the distances between the upper and lower strap attachment points on each opposing side of the strap support are fixed when the strap support is located on the wearer's skull and the respirator body is in position over the nose and mouth of the wearer;

wherein the distances between the upper and lower strap attachment points on each opposing side of the support crown are fixed when the respirator body is in position over the nose and mouth of the wearer;

and wherein the support crown comprises an adjustment mechanism, wherein the distances between the lower strap attachment points on opposite sides of the support crown are adjustable.

2. The respirator of claim 1, wherein the strap support comprises a support crown.

3. The respirator of claim 1, wherein the strap support comprises a skull cap.

4. The respirator of claim 1, further comprising a hard hat attached to the strap support.

5. The respirator of claim 1, wherein the lower straps are connected to the respirator body below the strap support when the strap support is located on the wearer's skull and the respirator body is in position over the nose and mouth of the wearer.

6. The respirator of claim 1, wherein the strap support comprises a plurality of upper strap attachment points.

7. The respirator of claim 1, wherein the strap support comprises a plurality of lower strap attachment points.

8. The respirator of claim 1, wherein the strap support comprises a plurality of upper strap attachment points and a plurality of lower strap attachment points.

9. The respirator of claim 1, wherein at least two of the upper and lower straps comprise a single continuous integral strap body.

10. A half-mask respirator that comprises:

a half-mask respirator body configured to cover the nose and mouth of the wearer;

a support crown located on the wearer's skull when the respirator body is in position over the nose and mouth of the wearer;

at least two upper straps that extend from opposite sides of an upper portion of the respirator body to opposing sides of the support crown, the upper straps connected to the support crown at upper strap attachment points; and at least two lower straps that extend from opposite sides of a lower portion of the respirator body to opposing sides of the support crown, wherein the lower straps are connected to the support crown at lower strap attachment points, and further wherein the lower straps are connected to the respirator body below support crown when the support crown is located on the wearer's skull and the respirator body is in position over the nose and mouth of the wearer;

wherein the distances between the upper and lower strap attachment points on each opposing side of the support crown are fixed when the respirator body is in position over the nose and mouth of the wearer.

11. The respirator of claim 10, wherein the support crown comprises a plurality of upper strap attachment points.

12. The respirator of claim 10, wherein the support crown comprises a plurality of lower strap attachment points.

13. The respirator of claim 10, wherein the support crown comprises a plurality of upper strap attachment points and a plurality of lower strap attachment points.

14. The respirator of claim 10, wherein at least two of the upper and lower straps comprise a single continuous integral strap body.

15. A half-mask respirator that comprises:

a half-mask respirator body configured to cover the nose and mouth of the wearer;

a strap support located on the wearer's skull when the respirator body is in position over the nose and mouth of the wearer;

at least two upper straps that extend from opposite sides of an upper portion of the respirator body to opposing sides of the strap support, the upper straps connected to the strap support at upper strap attachment points; and at least two lower straps that extend from opposite sides of a lower portion of the respirator body to opposing sides of the strap support, the lower straps connected to the strap support at lower strap attachment points;

wherein the distances between the upper and lower strap attachment points on each opposing side of the strap support are fixed when the strap support is located on the wearer's skull and the respirator body is in position over the nose and mouth of the wearer;

and wherein the strap support comprises an adjustment mechanism, wherein the distances between the upper and lower strap attachment points on each opposing side of the strap support are adjustable.

16. The respirator of claim 15, wherein the lower straps are connected to the respirator body below the strap support when the strap support is located on the wearer's skull and the respirator body is in position over the nose and mouth of the wearer.

17. The respirator of claim 15, wherein the strap support comprises a plurality of upper strap attachment points.

18. The respirator of claim 15, wherein the strap support comprises a plurality of lower strap attachment points.

19. The respirator of claim 15, wherein at least two of the upper and lower straps comprise a single continuous integral strap body.

20. A half-mask respirator that comprises:

a half-mask respirator body configured to cover the nose and mouth of the wearer;

a strap support located on the wearer's skull when the respirator body is in position over the nose and mouth of the wearer;

at least two upper straps that extend from opposite sides of an upper portion of the respirator body to opposing sides of the strap support, the upper straps connected to the strap support at upper strap attachment points; and at least two lower straps that extend from opposite sides of a lower portion of the respirator body to opposing sides of the strap support, the lower straps connected to the strap support at lower strap attachment points;

wherein the distances between the upper and lower strap attachment points on each opposing side of the strap support are fixed when the strap support is located on the wearer's skull and the respirator body is in position over the nose and mouth of the wearer;

and wherein the strap support comprises an adjustment mechanism, wherein the distances between the upper tap attachment points on opposite sides of the strap support are adjustable.

21. The respirator of claim 20, wherein the lower straps are connected to the respirator body below the strap support when the strap support is located on the wearer's skull and the respirator body is in position over the nose and mouth of the wearer.

22. The respirator of claim 20, wherein the strap support comprises a plurality of lower strap attachment points.

23. The respirator of claim 20, wherein at least two of the upper and lower straps comprise a single continuous integral strap body.

24. A half-mask respirator that comprises:

a half-mask respirator body configured to cover the nose and mouth of the wearer;

a strap support located on the wearer's skull when the respirator body is in position over the nose and mouth of the wearer;

at least two upper straps that extend from opposite sides of an upper portion of the respirator body to opposing sides of the strap support, the upper straps connected to the strap support at upper strap attachment points; and at least two lower straps that extend from opposite sides of a lower portion of the respirator body to opposing sides of the strap support, the lower straps connected to the strap support at lower strap attachment points;

wherein the distances between the upper and lower strap attachment points on each opposing side of the strap support are fixed when the strap support is located on the wearer's skull and the respirator body is in position over the nose and mouth of the wearer;

and wherein the strap support comprises an adjustment mechanism, wherein the distances between the lower strap attachment points on opposite sides of the strap support are adjustable.

25. The respirator of claim 24, wherein the lower straps are connected to the respirator body below the strap support when the strap support is located on the wearer's skull and the respirator body is in position over the nose and mouth of the wearer.

26. The respirator of claim 24, wherein the strap support comprises a plurality of lower strap attachment points.

27. The respirator of claim 24, wherein at least two of the upper and lower straps comprise a single continuous integral strap body.

28. A half-mask respirator that comprises:

a half-mask respirator body configured to cover the nose and mouth of the wearer;

a support crown located on the wearer's skull when the respirator body is in position over the nose and mouth of the wearer;

at least two upper straps that extend from opposite sides to an upper portion of the respirator body to opposing sides of the support crown, the upper straps connected to the support crown at upper strap attachment points; and at least two lower straps that extend from opposite sides of a lower portion of the respirator body to opposing sides of the support crown, wherein the lower straps are connected to the support crown at lower strap attachment points, and further wherein the lower straps are connected to the respirator body below support crown when the support crown is located on the wearer's skull and the respirator body is in position over the nose and mouth of the wearer;

wherein the distances between the upper and lower strap attachment points on each opposing side of the support crown are fixed when the respirator body is in position over the nose and mouth of the wearer;

and wherein the support crown comprises an adjustment mechanism, wherein the distances between the upper and lower strap attachment points on each opposing side of the support crown are adjustable.

29. The respirator of claim 28, wherein the support crown comprises a plurality of upper strap attachment points and a plurality of lower strap attachment points.

30. The respirator of claim 28, wherein at least two of the upper and lower straps comprise a single continuous integral strap body.

31. A half-mask respirator that comprises:

a half-mask respirator body configured to cover the nose and mouth of the wearer;

a support crown located on the wearer's skull when the respirator body is in position over the nose and mouth of the wearer;

at least two upper straps that extend from opposite sides of an upper portion of the respirator body to opposing sides of the support crown, the upper straps connected to the support crown at upper strap attachment points; and at least two lower straps that extend from opposite sides of a lower portion of the respirator body to opposing sides of the support crown, wherein the lower straps are connected to the support crown at lower strap attachment points, and further wherein the lower straps are connected to the respirator body below support crown when the support crown is located on the wearer's skull and the respirator body is in position over the nose and mouth of the wearer;

wherein the distances between the upper and lower strap attachment points on each opposing side of the support crown are fixed when the respirator body is in position over the nose and mouth of the wearer;

and wherein the support crown comprises an adjustment mechanism, wherein the distances between the upper strap attachment points on opposite sides of the support crown are adjustable.

32. The respirator of claim 31, wherein the support crown comprises a plurality of upper strap attachment points.

33. The respirator of claim 31, wherein at least two of the upper and lower straps comprise a single continuous integral strap body.

34. A half-mask respirator that comprises:

a half-mask respirator body configured to cover the nose and mouth of the wearer;

a support crown located on the wearer's skull when the respirator body is in position over the nose and mouth of the wearer;

at least two upper straps that extend from opposite sides of an upper portion of the respirator body to opposing sides of the support crown, the upper straps connected to the support crown at upper strap attachment points; and at least two lower straps that extend from opposite sides of a lower portion of the respirator body to opposing sides of the support crown, wherein the lower straps are connected to the support crown at lower strap attachment points, and further wherein the lower straps are connected to the respirator body below support crown when the support crown is located on the wearer's skull and the respirator body is in position over the nose and mouth of the wearer;

wherein the distances between the upper and lower strap attachment points on each opposing side of the support crown are fixed when the respirator body is in position over the nose and mouth of the wearer;

and wherein the support crown comprises an adjustment mechanism, wherein the distances between the lower strap attachment points on opposite sides of the support crown are adjustable.

35. The respirator of claim 34, wherein the support crown comprises a plurality of lower strap attachment points.

36. The respirator of claim 34, wherein at least two of the upper and lower straps comprise a single continuous integral strap body.

* * * * *

UNITED STATES PATENT AND TRADEMARK OFFICE

CERTIFICATE OF CORRECTION

PATENT NO. : 6,732,733 B1
APPLICATION NO. : 09/535847
DATED : May 11, 2004
INVENTOR(S) : Gerald M. Brostrom It is certified that error appears in the above-identified patent and that said Letters Patent is hereby corrected as shown below:

Column 9
Line 57, after "wearer", please delete ";" and insert therefore --.--.
Lines 58-65, please delete the following two paragraphs:
"wherein the distances between the upper and lower strap attachment points on each opposing side of the support crown are fixed when the respirator body is in position over the nose and mouth of the wearer;
and wherein the support crown comprises an adjustment mechanism,
wherein the distances between the lower strap attachment points on opposite sides of the support crown are adjustable."

Column 11
Line 44, delete "tap" and insert therefore --strap--.

Column 12
Line 30, before "an", delete "to" and insert therefore --of--.

Signed and Sealed this

Twenty-fourth Day of October, 2006

JON W. DUDAS
*Director of the United States Patent and Trademark Office*